US006195982B1

(12) United States Patent
Gysling et al.

(10) Patent No.: US 6,195,982 B1
(45) Date of Patent: Mar. 6, 2001

(54) APPARATUS AND METHOD OF ACTIVE FLUTTER CONTROL

(75) Inventors: Daniel L. Gysling, Glastonbury; Matthew R. Feulner, Tolland, both of CT (US); Kevin M. Eveker, Alexandria, VA (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/222,561

(22) Filed: Dec. 30, 1998

(51) Int. Cl.[7] ..... F02C 9/00; B63H 11/00

(52) U.S. Cl. ..... 60/204; 60/223; 60/39.29; 415/119

(58) Field of Search ..... 60/204, 223, 226.1, 60/262, 39.091, 39.29; 415/26, 27, 28, 119

(56) References Cited

U.S. PATENT DOCUMENTS

| | | | | |
|---|---|---|---|---|
| 4,199,295 | * | 4/1980 | Raffy et al. | 415/115 |
| 4,967,550 | | 11/1990 | Acton et al. | 60/39 |
| 5,005,353 | * | 4/1991 | Acton et al. | 60/39.281 |
| 5,340,271 | * | 8/1994 | Freeman et al. | 415/1 |

OTHER PUBLICATIONS

"Active Stability Management for Advanced Aeropropulsion Compression Systems" by K.M. Eveker, D.L. Gysling, C.N. Nett and O.P. Sharma, Sep., 1997, 9 sheets.

"Active Control of Cascade Flutter by Means of Sound Waves from Duct Wall Sources", by Kenichiro Nagai, Kazuhiko Toshimitsu and Masanobu Namba, JSME International Journal, Series B, vol. 39, No. 3, pp. 608–614, 1996.

* cited by examiner

*Primary Examiner*—Charles G. Freay
(74) *Attorney, Agent, or Firm*—McCormick, Paulding & Huber LLP

(57) ABSTRACT

A system for controlling aeromechanical instability or flutter in turbofan engines having fan blades employs a sensor, such as an off-blade static pressure sensor or proximity detector mounted on a turbofan engine at an inlet of a rotor of the engine for generating a signal to detect resonance of the turbofan blades at frequencies associated with flutter. A controller is coupled to the sensor for generating by spatial Fourier decomposition from the sensor signal a command signal comprising a real time amplitude component and a spatial phase of disturbances of a predetermined nodal diameter and coincident with a natural frequency of resonance of a predetermined structural mode of the fan blades in the stationary frame. An actuator, such as a bleed valve or acoustic speaker, is mounted on the turbofan engine for damping flutter dynamics in response to the amplitude of the command signal.

37 Claims, 6 Drawing Sheets

APPARATUS AND METHOD OF ACTIVE FLUTTER CONTROL

FIELD OF THE INVENTION

The present invention relates to an apparatus and method for preventing aeromechanical instabilities from occurring in turbofan engines, and more particularly relates to an apparatus and method for damping flutter dynamics in turbofan engines to prevent blade failure.

BACKGROUND INFORMATION

Turbofan engines are typically associated with running power plants or powering airplanes. With respect to airplanes, aeromechanical instabilities such as flutter may catastrophically lead to blade failure. Flutter is characterized by a resonance or elastic deformation of the turbofan blades generated by the coupling of the aerodynamics and the structural dynamics of the blades. The blades have natural and associated harmonic frequencies of resonance which are based on the blade structure or configuration. An axial turbomachinery blade is associated with structural mode shapes which are the natural patterns and frequencies in which the blade deflects and resonates when excited. A blade has more than one mode shape and each mode shape resonates at a particular frequency. When an instability such as flutter occurs, it is usually associated with one particular structural mode excited by the coupling with the unsteady aerodynamics. It is therefore vitally important to detect these instabilities in aeropropulsion compression systems and to dampen the instability dynamics to prevent such imminent blade failure.

Such aeromechanical instabilities impose significant constraints on the design and development of modern aero-engines. As shown in FIG. 8, of particular concern is flutter which has many occurances on a fan's pressure ratio (ordinate) versus mass flow (abscissa) operating map 400. As shown in FIG. 8, curves 402 and 404 respectively correspond to the operating line and flutter lines of the operating map. The constraint on blade design is to keep the flutter boundaries outside of the operating envelope of the engine.

FIGS. 1*a* and 1*b* illustrate (in exaggerated form) blade resonance or energy waves generated in a turbofan 200 having eight blades 202, 204, 206, 208, 210, 212, 214 and 216. The blades 200–216 are shown in solid form corresponding to a non-deflected state, and the blades 204–208 and 212–216 are also shown in phantom form corresponding to a deflected state during a resonance or elastic deformation of the blades which may arise due to flutter during blade rotation. FIG. 1*b* maps the degree of deformation of each blade during an instant of time where the amount of blade deformation in the direction of blade rotation is a positive value and the amount of blade deformation in the direction opposite to blade rotation is a negative value.

At an instant of time during rotation of the turbofan 200 in the clockwise direction, the blade 202 is shown in FIG. 1*a* to have no deformation which corresponds to a deformation value of zero units for the blade 202 as mapped in FIG. 1*b*. The blade 204 is shown in FIG. 1*a* to have a slight deformation in the direction of rotation which corresponds to a positive deformation of one unit for the blade 204 as mapped in FIG. 1*b*. The blade 206 is shown in FIG. 1*a* to have an even greater deformation relative to the blade 204 in the direction of rotation which corresponds to a positive deformation of two units for the blade 206 as mapped in FIG. 1*b*. The blade 208 is shown in FIG. 1*a* to have the same deformation as the blade 204 which corresponds to a positive deformation of one unit for the blade 208 as mapped in FIG. 1*b*.

The blade 210 is shown in FIG. 1*a* to have no deformation which corresponds to a deformation value of zero units for the blade 210 as mapped in FIG. 1*b*. The blade 212 is shown in FIG. 1*a* to have a slight deformation in a direction opposite to blade rotation which corresponds to a negative deformation of one unit for the blade 212 as mapped in FIG. 1*b*. The blade 214 is shown in FIG. 1*a* to have an even greater deformation relative to the blade 212 in the direction opposite to blade rotation which corresponds to a negative deformation of two units for the blade 214 as mapped in FIG. 1*b*. The blade 216 is shown in FIG. 1*a* to have the same deformation as the blade 212 which corresponds to a negative deformation of one unit for the blade 216 as mapped in FIG. 1*b*. The resonance pattern shown in FIGS. 1*a* and 1*b* correspond at an instant of time to one sinusoidally shaped cycle of deformation of the blades as seen along a 360° path circumaxially about the turbofan 200. However, other excitation patterns characterized by zero or multiple cycles contribute to flutter in aerocompression systems.

Flutter in axial turbomachinery typically occurs in specific nodal diameters dependent on the particular geometry of the turbomachinery. A nodal diameter is the wave number of the sinusoid that the blade deflection pattern represents. FIGS. 2*a*–2*c* illustrate various nodal diameters of the blade deflection pattern of turbofan blades. The length and direction of the arrows in each figure define respectively the degree and direction (positive or negative direction) of the turbofan blades as viewed at an instant of time about the rotational axis of the turbofan from a start point (0°) to the end point (360°). As is evident, the start and end points are the same physical position. FIG. 2*a* illustrates a 0th nodal diameter pattern 227 of arrows 229 diagrammatically representing the direction and degree of blade deflection in which each turbofan blade exhibits no blade deflection or the same amount of blade deflection with respect to one another when viewed at an instant of time at any point around the axis of rotation of the turbofan. FIG. 2*b* shows a 1st nodal diameter deflection pattern 231 of arrows 233 representing blade deflection at an instant of time in which the turbofan blades as viewed circumaxially about the turbofan exhibit a single cycle generally sinusoidal wave pattern. Such nodal diameter deflection patterns illustrate the general resonance deflection pattern of a turbofan in a manner which is independent of the actual number of blades comprising the turbofan. As can be seen, the 1st nodal diameter deflection pattern of FIG. 2*b* corresponds to the deflection pattern embodied by the eight turbofan blades in FIG. 1*a*. FIG. 2*c* illustrates a 3rd nodal diameter deflection pattern 235 of arrows 237 representing blade deflection at an instant of time in which the turbofan blades as viewed circumaxially about the turbofan axis of rotation exhibit a three cycle generally sinusoidal wave pattern. The structural mode shape is the natural pattern in which an axial turbomachinery blade deflects and resonates when excited. A blade has more than one mode shape and each mode shape resonates at a particular frequency. When flutter occurs, it usually is associated with one particular structural mode. Flutter is difficult to predict analytically and expensive to investigate experimentally. Consequently, flutter is often encountered only in the final phases of engine development leading to expensive delays and often forcing a degradation in overall system performance.

In response to the foregoing, it is an object of the present invention to overcome the drawbacks and disadvantages of prior art apparatus and methods for preventing aeromechanical instabilities in aero-engines.

SUMMARY OF THE INVENTION

In one aspect, a system for damping the aeromechanical instability of flutter in a turbofan engine having a plurality of blades spaced substantially equidistant from each other about a rotational axis includes a sensor to be mounted on a turbofan engine outwardly from turbofan blades at an inlet of a rotor of the engine for generating a sensor signal indicative of resonance of the turbofan blades at frequencies associated with flutter. A controller is coupled to the sensor for generating from the sensor signal a command signal comprising a real time amplitude component and a spatial phase of disturbances of a predetermined nodal diameter and including a natural frequency of vibration of a predetermined structural mode of the fan blades. An actuator is to be mounted on the turbofan-engine outwardly from the turbofan blades for controlling flutter in response to the command signal.

In another aspect of the present invention, a method of damping the aeromechanical instability of stall flutter in a turbofan engine having a plurality of blades spaced substantially equidistant from each other about a rotational axis includes sensing blade resonance associated with stall flutter at a location outwardly from the turbofan blades at an inlet of a rotor of the engine and generating a sensor signal indicative of the inception of flutter. A command signal is generated by spatial Fourier decomposition of the sensor signal into a real time amplitude component and a spatial phase of disturbances of a predetermined nodal diameter and including a natural frequency of vibration of a predetermined structural mode of the fan blades. The flutter dynamics are damped in response to the amplitude of the command signal.

DETAILED DESCRIPTION OF THE PREFERRED EMBODIMENTS

Figure 1B:
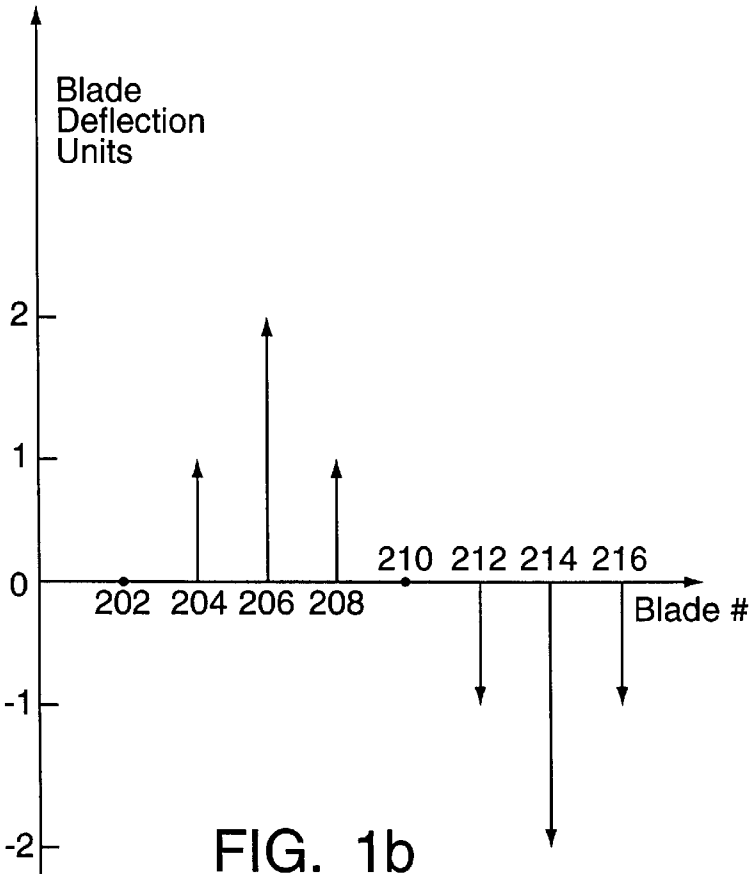
FIG. 1*b* schematically maps the degree of deflection of the blades shown in FIG. 1*a* as a function of the frequency of blade resonance.
Figure 1A:
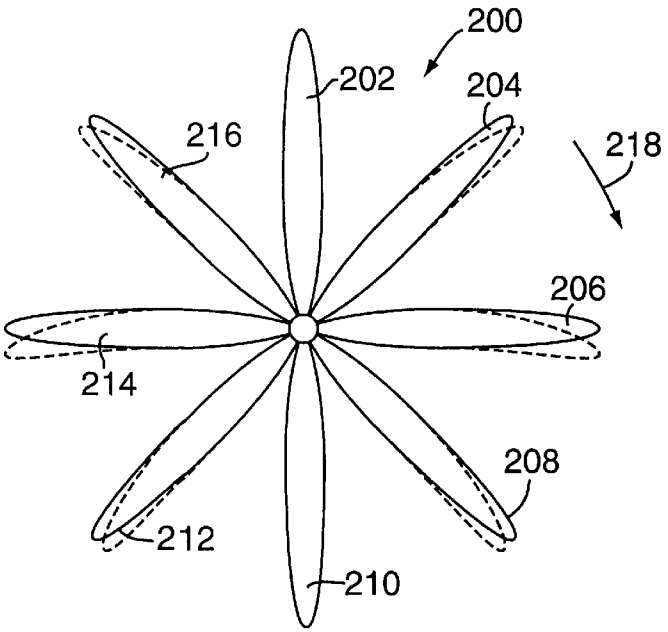
FIG. 1*a* schematically illustrates elastic deformation of turbofan blades at a natural frequency of excitation.
Figure 2A:
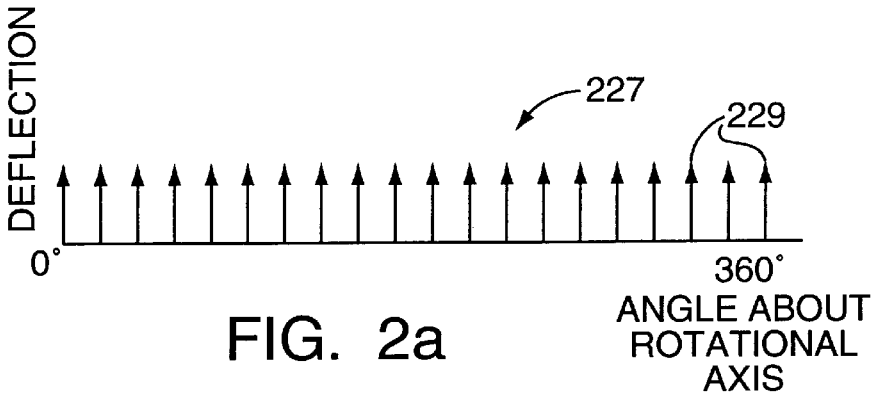
FIG. 2*a* illustrates a 0th nodal diameter blade deflection pattern of turbofan blades.
Figure 2B:
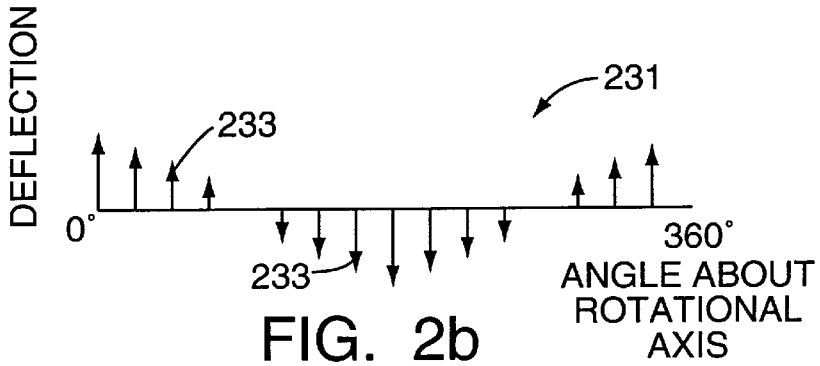
FIG. 2*b* illustrates a 1st nodal diameter blade deflection pattern of turbofan blades.
Figure 2C:
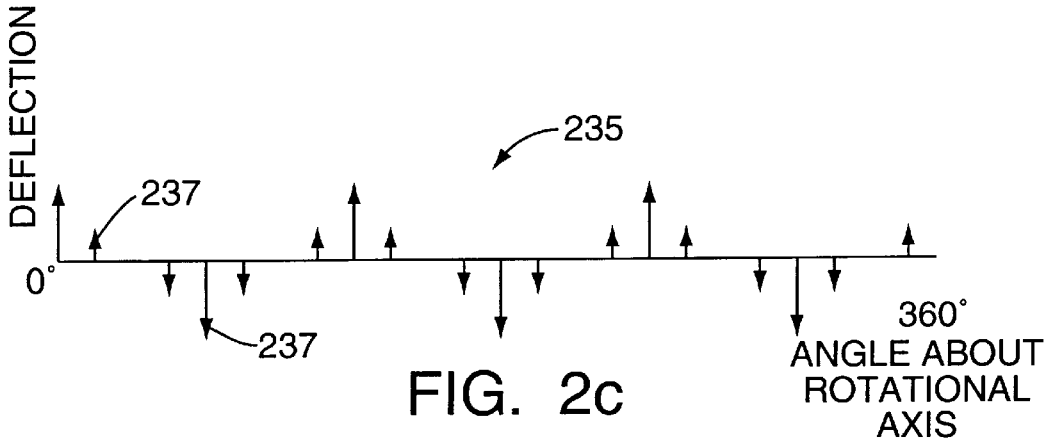
FIG. 2*c* illustrates a 3rd nodal diameter blade deflection pattern of turbofan blades.
Figure 8:
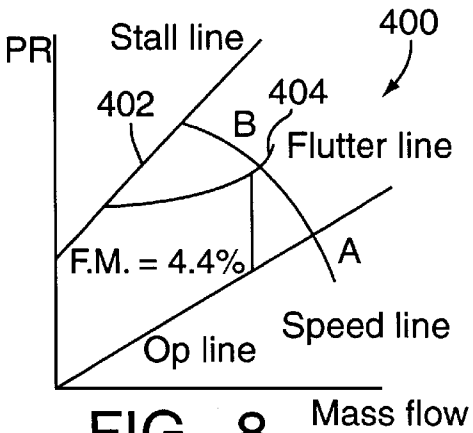
FIG. 8 is a turbofan engine pressure ratio vs. mass flow performance graph illustrating the proximity of the stall flutter operating region and the stall line at low mass flow.
Figure 3:
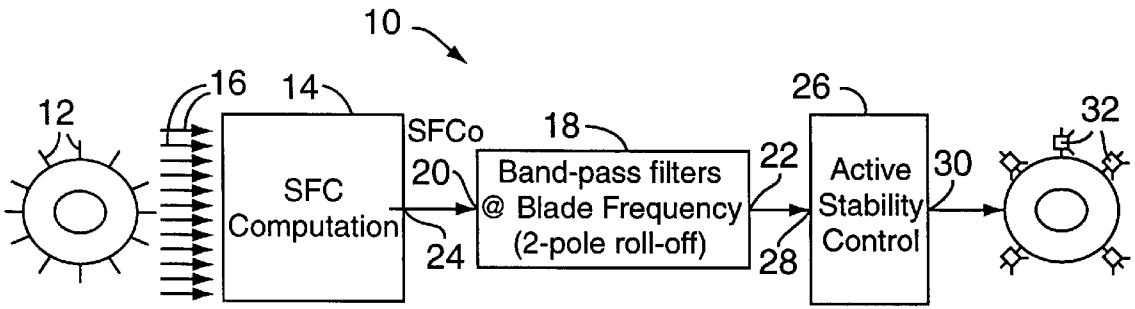
FIG. 3 is a block diagram of an off-blade turbofan engine flutter control system of a first embodiment of the present invention.

FIG. 3 schematically shows partly in block diagram form an off-blade active flutter control system 10 according to the present invention used in connection with a compression system of a turbofan engine. A plurality of static pressure sensors 12, 12 forming a sensor array are mounted outwardly from and circumaxially about turbofan blades at an inlet of a rotor of the engine (not shown) for generating static pressure signals to detect pressure variations generated by blade resonance associated with the inception of flutter in the engine. The static pressure sensors 12, 12 are coupled to a spatial Fourier component (SFC) sub-circuit 14 via lines indicated by arrows 16, 16 for translating the time-varying pressure signal into a nodal diameter pattern that is suited for detecting frequencies associated with aeromechanical instabilities such as flutter. A bandpass filter 18 has an input 20 and an output 22. The input 20 of the bandpass filter 18 is coupled to an output 24 of the SFC sub-circuit 14. An active stability control sub-circuit 26 has an input 28 and an output 30. The input 28 of the active stability control sub-circuit 26 is coupled to the output 22 of the bandpass filter 18. A plurality of actuators, such as high-response or high-bandwidth bleed valves 32, 32, are positioned circumaxially about the inner periphery of the engine at the compressor discharge to provide annulus-averaged actuation. The bleed valves 32, 32 have control inputs that are coupled to the output 30 of the active stability control sub-circuit 26.

The circumaxial array of static pressure sensors 12, 12 detect localized static pressure variations associated with the inception of aeromechanical instabilities, such as flutter. When turbofan blades resonate at frequencies associated with flutter, the resonating blades generate pressure variations in the vicinity of the blade tips which are detected by the static pressure sensors 12, 12. The pressure measurements are acquired at bandwidths of about ten times the rotor frequency. The output of the sensors 12, 12 are decomposed by means of the SFC sub-circuit 14 into the real time amplitude and spatial phase of disturbances of a specified nodal diameter (ND) and including the natural frequency of the specified structural mode of the fan blade. The nodal diameters of interest are typically less than the number of rotor blades divided by 5. For large turbofan engines, the frequency of fan blade flutter (expressed by the equation $w=w_{blade}\pm w_{rotor}*$ ND), as observed in the stationary reference frame is typically in the hundreds of Hertz range.

Since flutter typically occurs in a small subset of the possible structural mode shapes and nodal diameters of the turbofan blades of an aeroengine, the bandpass filters 18 are employed to increase signal to noise ratios of the SFC signal generated from the SFC sub-circuit 14 by passing generally only the frequency range which is indicative of flutter. The bandpassed filtered signal generated at the output 22 of the bandpass filters 18 are then fed into the input 28 of an active stability control sub-circuit 26 which generates a command signal having spatial and magnitude information of sufficient proportion to control a spatial array of actuators such as the bleed valves 32, 32. The actuators need to have sufficient spatial distribution and bandwidth to modify or dampen the flutter dynamics. In theory, many actuator configurations can be used to control flutter of different nodal diameters. If an actuator configuration can produce a disturbance which has a component in the nodal diameter of interest, then it can control that nodal diameter flutter. The preferred spatial distribution of the actuators is related to the nodal diameter number of the aeroelastic instability to be stabilized. More specifically, the number of actuators is expressed by the equation:

$$\text{Actuator Number} \geq 2^* \text{ Nodal Diameter of Interest} + 1.$$

The bleed valves 32, 32 are controllably opened in response to the control signal from the active stability control sub-circuit 26 to alter air pressure within the compression system of the turbofan engine in order to dampen flutter dynamics by countering the pressure variations around the turbofan blades caused by flutter. In other words, the bleed valves are controlled to modify the feedback of the aerodynamics to provide damping rather than amplification of blade vibration.

Real time feedback introduced by the system 10 directly augments the damping of the aeroelastic system, thus extending the flutter-free operating range. Since the control system alters the damping of the system by responding to small amplitude disturbance, the steady operating characteristic of the turbofan is unaltered by this control system, and the net result is to shift the stall flutter boundary in relation to the stall line to a low mass flow. Since this system augments system damping, a similar concept can be employed to reduce resonance stress phenomena that can lead to high cycle fatigue.

Flutter stabilization as provided by the present invention was implemented on a sub-scale transonic model of a high bypass ratio turbofan. The system employed static pressure sensors at the inlet of the rotor and used high response bleed valves as actuators. This flutter control system can be employed with a variety of actuators and sensors, such as, for example, eddy current sensors in combination with acoustic speakers as will be later explained in another embodiment.

The embodiment as applied to the 17 inch fan rig had a 0th nodal diameter stall flutter in the 1st structural mode of the fan blades. The natural frequency of the blades was approximated at 270 Hz. An array of eight static pressure sensors at the inlet to the fan rotor were used to calculate the 0th spatial Fourier component (SFC) at an update rate of about 3000 Hz. The 0th SFC was then passed through a 250 Hz to 310 Hz bandpass filter to eliminate extraneous signals and to introduce a phase shift in time. The filtered 0th SFC pressure signal was then scaled by a gain factor ($k=-20$) in the active stability control and fed into an array of five equally spaced, high response bleed valves. Each bleed valve was opened to a nominal offset position to which the position commanded by the active control system was superimposed. Control of the 0th nodal diameter flutter extended the stable operating range by at least 5%.

The bleed valves 32, 32 maintain a non-zero offset when the compression system is subjected to disturbances that would cause the uncontrolled compression system to stall. Although the level of this offset scales with the level of stability threatening disturbances acting on the system, the controller is not merely avoiding the phenomenon by increasing throttle area to compensate for the disturbance. The controller is modifying the system dynamics resulting in operation at a point that could not be achieved without the feedback introduced by the control system.

Figure 4A:
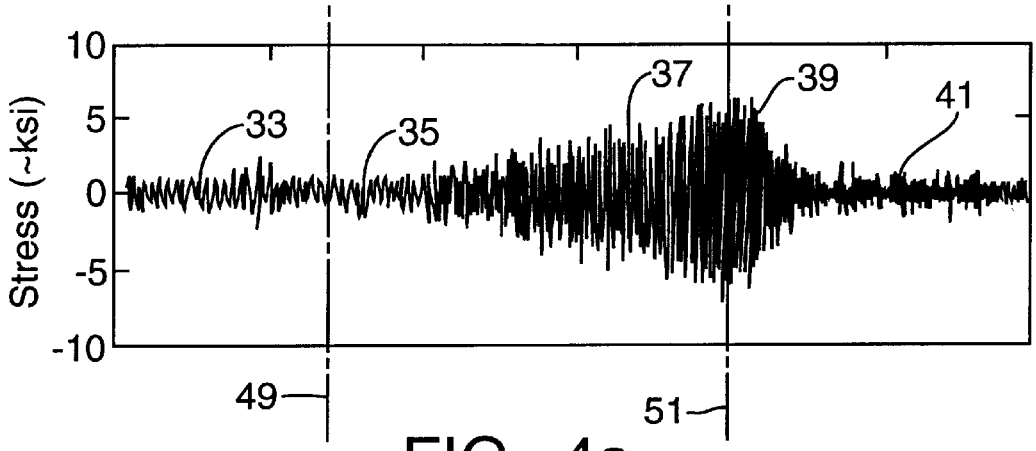
FIG. 4*a* is a graph illustrating control of air flow through bleed valves serving as actuators in a compression system of a turbofan engine to control stall flutter.
Figure 4B:
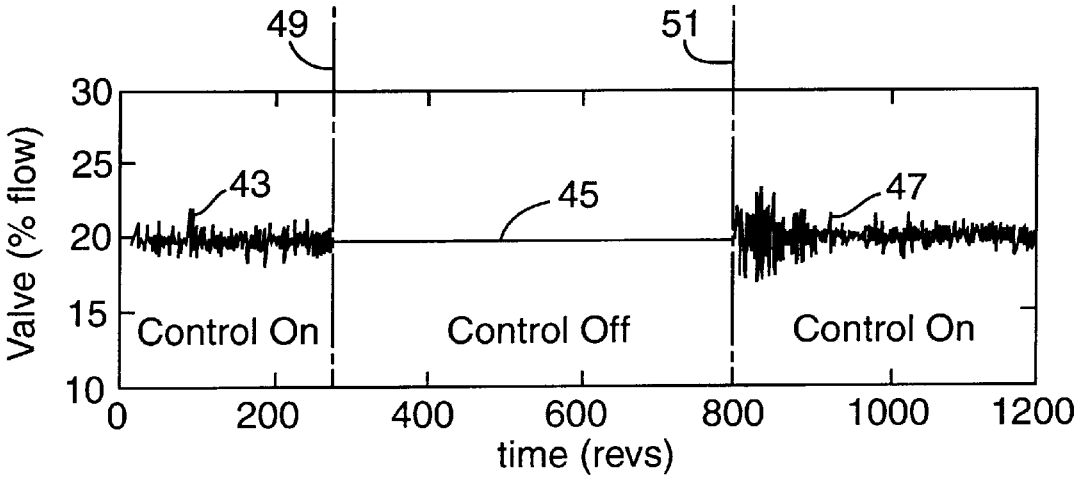
FIG. 4*b* is a graph illustrating the stress of a turbofan in response to the flutter control system of the present invention.

FIGS. 4*a* and 4*b* show the time history of blade stress in kilograms per square inch (ksi) (FIG. 4*a*) and valve position or percentage of flow (FIG. 4*b*) in relation to time measured fan blade revolutions per second. As shown in FIG. 4*b*, spikes 43 (to the left of dashed line 49) and 47 (to the right of dashed line 51) show the regions where the valve is actuated for damping flutter dynamics, and the flat line 45 (between the dashed lines 49 and 51) shows the region where the valve is inactive. Initially the fan is operating in a stabilized region beyond the open loop flutter boundary with the system 10 activated. The stabilized region is shown in FIG. 4*a* as the portion of the figure to the left of dashed line 49 in which the blades exhibit manageable stress as shown by the relatively short spikes 33. The system 10 is then deactivated at the time indicated by the line 49 and the aeroelastic system is rendered unstable as shown between the dashed lines 49 and 51. A 0th nodal diameter flutter develops and grows exponentially where blade stress increases from a manageable level as shown by spikes at 35 to a dangerous level as shown by spikes at 37. Such an exponential increase in blade stress is characteristic of linear instability. The system 10 is then reactivated at the time indicated by the line 51. The system, as seen to the right of dashed line 51, dampens the flutter dynamics so that the dangerous level of blade stress shown by the spikes at 39 is reduced to a manageable level as shown by the shorter spikes at 41 so as to return the system to flutter-free operation. The system 10 is believed to be a first system to employ transonic flutter control with off-blade sensing and actuation.

Figure 5:
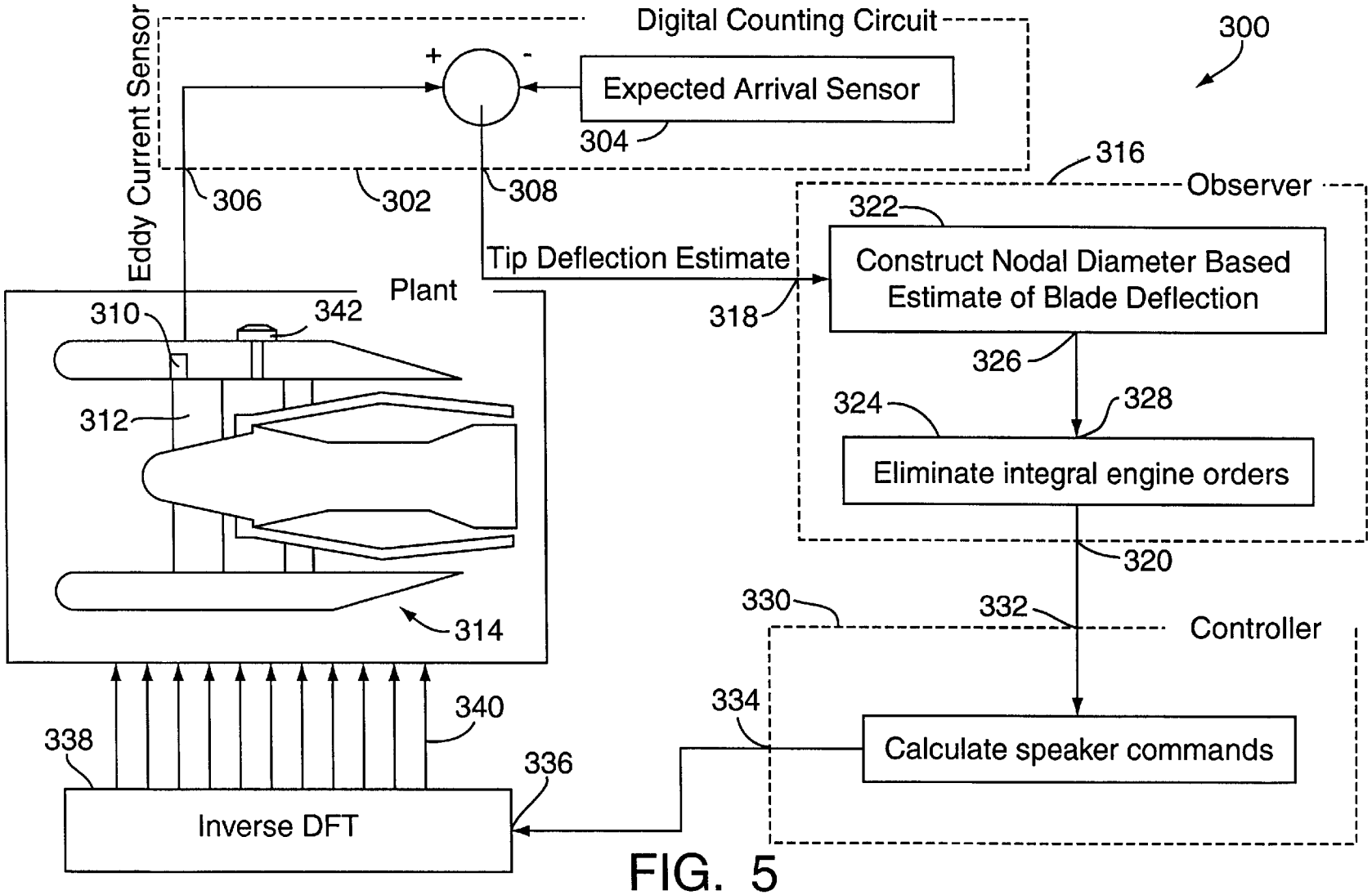
FIG. 5 schematically illustrates an off-blade active flutter control system of a second embodiment of the present invention.
Figure 6:
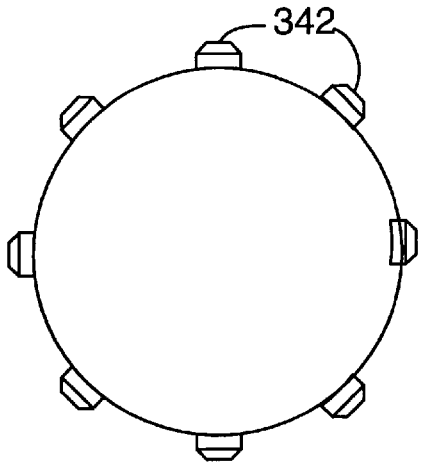
FIG. 6 schematically illustrates a plurality of actuators provided circumaxially about a turbofan.
Figure 7:
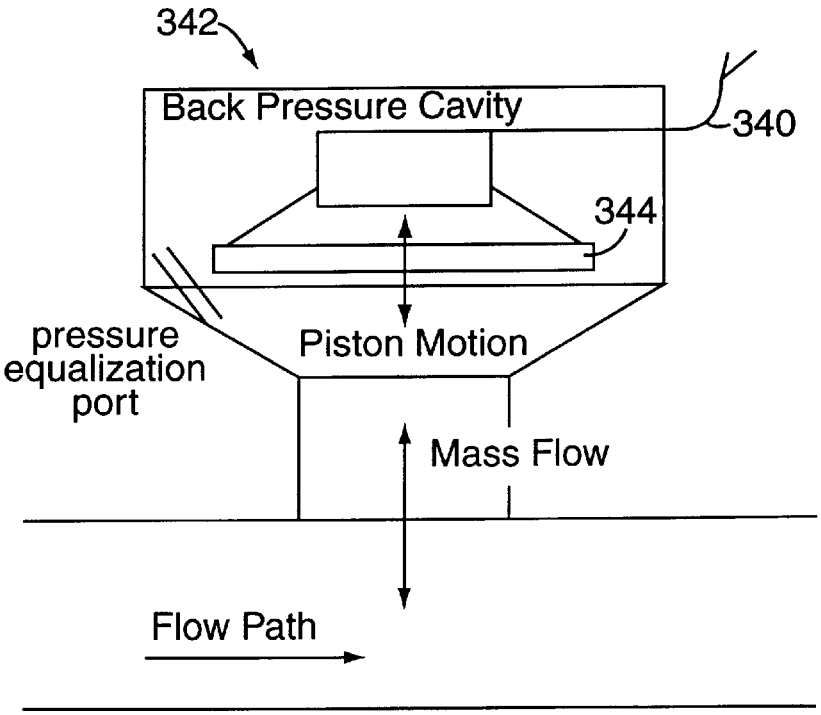
FIG. 7 schematically illustrates in greater detail a volumetric speaker actuator of the embodiment of FIG. 5.

FIG. 5 schematically illustrates a second embodiment of an off-blade flutter control system 300 in accordance with the present invention. The system includes a digital counting circuit 302 which includes an expected arrival sensor 304. The digital counting circuit has an input at 306 and an output at 308. The input 306 of the digital counting circuit 302 is coupled to an eddy current or proximity sensor 310 mounted outwardly of turbofan blades 312 of a turbofan engine 314. An observer circuit 316 has an input at 318 and an output at 320. The observer circuit 316 includes a nodal diameter construct sub-circuit 322 and a filter sub-circuit 324. The nodal diameter construct sub-circuit has an input coinciding with the input 318 of the observer circuit 316, and has an output 326 coupled to an input 328 of the filter sub-circuit 324. The filter sub-circuit has an output coinciding with the output 320 of the observer circuit 316. A controller 330 which calculates actuator or acoustic speaker command signals has an input 332 and an output 334. The input 332 of the controller 330 is coupled to the output 320 of the observer circuit 316, and the output 334 of the controller 330 is coupled to an input 336 of an inverse discrete Fourier transform (DFT) circuit 338. The inverse DFT circuit 338 has a plurality of outputs 340, 340 coupled to one or more volumetric sources, such as acoustic speaker actuators 342. As shown in FIG. 6, a plurality of the speakers 342, 342 may be provided circumaxially about the turbofan blades and each speaker coupled to one of the lines 340 from the inverse DFT circuit 338 in order to precisely dampen localized stall flutter disturbances about the turbofan. As shown in FIG. 7, each of the speakers 342 includes a piston 344 movable in either an upward or downward direction as controlled by one of the lines 340 from the inverse DFT circuit 338 for altering the mass flow near a turbofan blade in order to dampen flutter dynamics.

With reference to FIG. 5, the proximity sensor 310 is positioned slightly outward from the turbofan blade tips so as to detect when each turbofan blade arrives at and passes the sensor 310. Because of positive blade deflection caused by flutter (i.e., the blade deflects in the direction of blade rotation), the actual arrival time of each blade passing the proximity sensor 310 will be slightly earlier than the expected arrival time (i.e., the arrival time when there is no blade deflection) as calculated by the expected arrival sensor 304. Similarly, negative blade deflection (i.e., the blade deflects in a direction opposite to the direction of blade rotation) causes the actual arrival time as detected by the proximity sensor to be later than the expected arrival time. The digital counting circuit calculates the time difference between the actual arrival time of each blade passing the proximity sensor 310 and the expected arrival time as determined by the expected arrival sensor 304 to form a tip deflection estimate signal at the output 308 of the digital counting circuit 302.

Provided the blade tip speed respect to a fixed frame of reference is generally dominated by the rotor speed (and not the natural blade oscillation), the arrival time deviation will be roughly proportional to the blade deflection at the arrival location or at the proximity sensor 310. The blade deflection will reflect the superposition of all aeromechanical modes. However, due to their separation in frequency, the modal content can be easily decomposed into respective frequency components and spatial phases.

The observer circuit 316, such as a linear observer or Kalman filter, receives the tip deflection estimate signal at the input 318 to estimate the aeromechanical modal content of a blade row. A linear model for the flutter dynamics of interest is implemented in nodal diameter construct sub-circuit 322. A model for each aeromechanical mode (specific to the geometry of the blades) is obtained by running swept-sine signals to the system and measuring the complex ratio between the modal forcing function and the blade deflection at a point in the fixed frame. Then a low order (typically second order) state-space linear system can be fit to this data and the observer designed based on the aggregate of all these state-space blocks.

The tip deflection estimates received by the linear observer circuit 316 have a rate equal to the blade arrival interval. To increase the sampling rate it is necessary to install proximity sensors at distances smaller than the blade pitch. For example, if the desired sampling rate is twice the blade arrival interval then two proximity sensors must be placed at half the blade pitch. For processing convenience it is best to place the proximity sensors at equal spacing within the blade pitch. These sensor signals can be combined by the observer circuit 316 to deliver a state-estimate sampling period equal to the blade travel time between adjacent proximity sensors. Multiple proximity sensors are important when controlling higher-order forward traveling aeromechanical modes with high natural frequencies (as viewed from a fixed frame of reference).

The nodal diameter construct sub-circuit 322 of the observer circuit 316 estimates the state of all the detected aeromechanical modes to generate a nodal diameter estimate signal which is fed from the nodal diameter construct sub-circuit 322 to the filter sub-circuit 324. Simple pole-placing techniques can be used to design a linear control law capable of adding any desired amount of damping. The constraint in practice on the achievable level of damping is related to the gap between the model and the actual aeromechanical mode and the amount of control authority available. The irrelevant modes not associated with stall flutter are removed by the filter-sub-circuit 324. The filtered signal is then fed to the controller 330 for calculating speaker command signals that are received by the inverse DFT circuit 338.

Volumetric sources, such as the acoustic speakers 342 mounted on the fan case (see FIG. 6), are placed aft of the blade-row (as shown in FIG. 5) to modulate the back pressure and mass flow (see FIG. 7) as a function of angular position and time resulting in unsteady loading of the blades. The modulated back pressure and mass flow in turn modifies the blade lift to generate the desired commanded force on the blades. By arranging an array of actuators circumaxially about the turbofan, a pattern of forces on the blades can be created. These patterns can rotate in a traveling wave and have the spatial shape of the aeromechanical modes.

In a system having the foregoing invention, active flutter control was employed with an array of audio-speaker-powered volumetric sources connected to the flow path and equally spaced along the circumference axially located between a fan and its exit guide vanes (stator). Two blade arrival detectors based on eddy current sensors placed at the leading end of the blade tip line at half a blade pitch were used to generate real-time blade deflection signals. An observer circuit and pole-placement controller reconstructed the aeromechanical modes and generated the speaker command signals. The digital control system stabilized flutter and further dampened an order of magnitude larger than the intrinsic aeromechanical damping of the modes on the operating line of the fan.

As will be recognized by those skilled in the pertinent art, numerous modifications may be made to the above-described and other embodiments of the present invention without departing from the scope of the appended claims. For example, other types of actuators such as electromagnetic devices and synthetic jets may be employed. Furthermore, other types of sensors such as optical probes and microphones may be used. Accordingly, the detailed description of the preferred embodiments herein is to be taken in an illustrative, as opposed to a limiting sense.

What is claimed is:

1. A system for damping the aeromechanical instability of stall flutter in a turbofan engine having a plurality of blades having natural frequencies of resonance and structural modes associated with stall flutter spaced substantially equidistant from each other about a rotational axis, the system comprising:

a flutter sensor remotely positioned from turbofan blades at an inlet of a rotor of the engine for generating a sensor signal indicative of resonance of the turbofan blades at frequencies associated with stall flutter;

a controller coupled to the flutter sensor for generating from the sensor signal a command signal including a real time amplitude component and a spatial Fourier component (SFC) of disturbances of a predetermined nodal diameter and coincident with a natural frequency of resonance of a predetermined structural mode of the fan blades; and an actuator in communication with the controller for modulating air pressure in response to the command signal of the controller in order to dampen stall flutter dynamics.

2. A system as defined in claim 1, wherein the nodal diameters of the aeromechanical instability to be stabilized are $\leqq 4$.

3. A system as defined in claim 1, further including a bandpass filter for filtering the SFC of the command signal.

4. A system as defined in claim 3, wherein the bandpass filter receives the 0th spatial Fourier component of the command signal, and passes a filtered spatial Fourier component of the command signal in the frequency range of about 250 Hertz to about 310 Hertz.

5. A system as defined in claim 3, further including a signal amplitude scaler for scaling an amplitude of the filtered SFC of the command signal by a gain factor, and wherein the scaled signal is received by a control input of the actuator to open the actuator to a predetermined offset position.

6. A system as defined in claim 5, wherein the gain factor is about −20.

7. A system as defined in claim 1, wherein the flutter sensor is a proximity detector for detecting when each blade of the turbofan passes the proximity detector.

8. A system as defined in claim 7, wherein the proximity detector is an active eddy current detector.

9. A system as defined in claim 1, wherein the flutter sensor is a static pressure sensor for detecting changes in localized pressure near the blades caused by blade resonance at frequencies associated with stall flutter.

10. A system as defined in claim 9, wherein the controller updates data received from the static pressure sensor at a rate of about 3000 Hertz.

11. A system as defined in claim 9, wherein the static pressure sensor may include additional static pressure sensors distributed circumaxially about the inlet of the rotor, the number of static pressure sensors being≧(2* nodal diameter of the aeromechanical instability to be stabilized)+1.

12. A system as defined in claim 1, wherein the actuator is a high-response bleed valve for altering internal pressure of the turbofan engine to dampen stall flutter dynamics in response to the command signal of the controller.

13. A system as defined in claim 1, wherein the actuator includes an acoustic speaker for controlling stall flutter.

14. A system as defined in claim 1, wherein the flutter sensor is a proximity detector for determining the actual arrival time of a turbofan blade, and further comprising a digital counting circuit for calculating a blade tip deflection estimate signal based on the difference between the expected and actual arrival times of a turbofan blade, the digital counting circuit including the proximity detector for determining the actual arrival time of a turbofan blade, and an expected arrival time sensor for determining the expected arrival time of a turbofan blade.

15. A system as defined in claim 14, wherein the proximity detector is an active eddy current detector.

16. A system as defined in claim 14, further comprising an observer circuit for estimating the aeromechanical modal content of the turbofan blades, the observer circuit including:

a nodal diameter construct sub-circuit for generating a nodal diameter estimate signal; and a filter sub-circuit for filtering the command signal.

17. A system as defined in claim 14, further including an inverse discrete Fourier transform (DFT) circuit coupled to the actuator for relaying command signals to the actuator.

18. A system as defined in claim 17, wherein the actuator includes at least one volumetric source.

19. A system as defined in claim 18, wherein the inverse DFT circuit has a plurality of outputs coupled to the at least one volumetric source.

20. A system as defined in claim 18, wherein the at least one volumetric source includes an acoustic speaker.

21. A system as defined in claim 18, wherein the at least one volumetric source is a plurality of volumetric sources arranged circumaxially about the turbofan.

22. A method of damping the aeromechanical instability of stall flutter in a turbofan engine having a plurality of blades having natural frequencies of resonance and structural modes associated with stall flutter spaced substantially equidistant from each other about a rotational axis, comprising the steps of:

sensing blade resonance associated with stall flutter at a location outwardly from the turbofan blades at an inlet of a rotor of the engine and generating a sensor signal indicative of the inception of stall flutter;

generating from the sensor signal a command signal including a real time amplitude component and a spatial Fourier component (SFC) of disturbances of a predetermined nodal diameter and coincident with a natural frequency of resonance of a predetermined structural mode of the fan blades; and damping stall flutter dynamics in response to the command signal.

23. A method as defined in claim 22, wherein the step of sensing includes sensing the static pressure at a location outwardly from the turbofan blades and generating a pressure signal to detect static pressure variations associated with the inception of stall flutter.

24. A method as defined in claim 22, wherein the step of sensing includes a proximity detector which determines when the blades pass the proximity detector.

25. A method as defined in claim 22, wherein the step of sensing includes a static pressure sensor provided outwardly from the blades for sensing localized pressure variations due to resonance of the blades at frequencies associated with stall flutter.

26. A method as defined in claim 22, wherein the step of damping includes a high response bleed valve for altering localized pressure near the blades in response to the command signal.

27. A method as defined in claim 23, wherein the step of damping includes an acoustic speaker for altering localized pressure near the blades in response to the command signal.

28. A method as defined in claim 22, wherein the step of sensing is updated at a rate of about 3000 Hz.

29. A method as defined in claim 22, further including the step of bandpass filtering the SFC of the command signal.

30. A method as defined in claim 29, wherein the step of filtering includes receiving the 0th spatial Fourier component (SFC) of the command signal and passing the SFC of the command signal in the frequency range of about 250 Hz to about 310 Hz.

31. A method as defined in claim 22, further including the step of scaling the filtered SFC of the command signal by a gain factor to form a scaled signal, and the scaled signal is received by a control input of the actuator to open the actuator to a predetermined offset position.

32. A method as defined in claim 31, wherein the step of scaling includes scaling with a gain factor of about −20.

33. A method as defined in claim 22, wherein the step of sensing includes sensing the static pressure at a location outwardly from the turbofan blades, generating a pressure signal to detect static pressure variations associated with the inception of flutter, sensing an expected arrival time, and generating a blade tip deflection signal indicative of the inception of flutter.

34. A method as defined in claim 33, further including the step of filtering the command signal.

35. A method as defined in claim 34, wherein the step of filtering includes estimating the aeromechanical modal content of a turbofan blade row based on the blade tip deflection signal, generating a nodal diameter estimate signal, and filtering out modes not associated with stall flutter.

36. A method as defined in claim 34, wherein the step of damping includes altering the mass flow near the blades by at least one volumetric source in response to the command signal.

37. A method as defined in claim 36, wherein the volumetric source is an acoustic speaker actuator.

* * * * *